US005607222A

United States Patent [19]

Woog

[11] Patent Number: 5,607,222

[45] Date of Patent: Mar. 4, 1997

[54] LOW POWER ILLUMINATION DEVICE

[76] Inventor: Gunter Woog, 5435 Bauers Dr., West Bend, Wis. 53095

[21] Appl. No.: 517,332

[22] Filed: Aug. 21, 1995

[51] Int. Cl.[6] ..... F21V 9/16

[52] U.S. Cl. ..... 362/84; 362/30; 362/276; 362/293; 362/802; 40/542

[58] Field of Search ..... 362/23, 28–30, 362/84, 276, 293, 802; 40/542, 543, 570

[56] References Cited

U.S. PATENT DOCUMENTS

| | | | |
|---|---|---|---|
| 2,455,951 | 12/1948 | Roper et al. | 362/84 |
| 3,828,611 | 8/1974 | Shamlian et al. | 362/84 |
| 4,213,115 | 7/1980 | Wetzel | 362/84 |
| 4,991,537 | 2/1991 | Muramatsu | 362/84 |
| 5,253,150 | 10/1993 | Vanni | 362/84 |

FOREIGN PATENT DOCUMENTS

| | | | |
|---|---|---|---|
| 2262988 | 7/1993 | United Kingdom | 362/84 |

*Primary Examiner*—Ira S. Lazarus
*Assistant Examiner*—Alan B. Cariaso
*Attorney, Agent, or Firm*—Ryan, Maki, Mann & Hohenfeldt

[57] ABSTRACT

A low power consumption illumination device includes a housing, with a display forming at least one surface of the housing. The display bears at least one inscription formed of a non-radioactive luminescent coating. An activation device for the phosphor-containing luminescent coating includes a battery or storage capacitor powered light which is programmed to emit a flash of light on appropriate intervals for periodic reactivation of the phosphors. The light is preferably in the UV frequency range. The display it thus enabled to emit light over a prolonged period of time.

5 Claims, 1 Drawing Sheet

LOW POWER ILLUMINATION DEVICE

Field of the Invention

This invention relates to an ultra low power consumption nighttime illumination device. More specifically, the invention relates to such a device which utilizes a non-radioactive luminescent material such as paint that can be intermittently activated by means of a battery-activated, brief, light pulse.

BACKGROUND OF THE INVENTION

Luminescent lighting devices for providing lighted signs and the like and are often utilized in locations where an electrical power supply is lacking. Previously, such devices often have utilized radioactive paint components. However, due to environmental and health concerns, more recently, non-radioactive luminescent paints have been developed. Earlier types of luminescent type paints required extended exposure to a bright light. Light for activation of various newly-developed phosphors and phosphor based paints can be provided by periodic or intermittent exposure to a bright flash of light such as a strobe light.

A need has existed for improved lighting, for example for exit signs, arrows, clock dials or signs providing advertising or instructive displays which can, by periodic activation, be illuminated for sufficient lengths of time to, for example, provide lighting for the duration of a one night interval of at least eight hours. Such displays can be, thus, operated in the absence of a power supply other than a battery or storage capacitor of sufficient strength to operate a strobe light. Such displays are useful in dark locations such as outdoor locations, buildings, tunnels, underground caverns, or other locations where the providing of a standard power supply would be difficult.

SUMMARY OF THE INVENTION

It is an object of the present invention to provide an illuminated device which utilizes non-radioactive luminescent paint and contains within the device a battery or capacitor activated strobe light which maintains the activation of the luminescent paint for an extended period of time. A related aspect of the invention is to provide such a device wherein the activating light, such as a strobe light and battery or storage capacitor are located internally within the display device.

A further aspect of the invention relates to providing such a device which is activated only during periods of darkness and which contains a light monitoring means and circuit for this purpose. In accordance with a related aspect, a light monitoring device can be included in a device of this invention which triggers an activating light upon indication that the light emanating from the luminescent paint has dropped below a preselected threshold.

Briefly, the invention provides a low power consumption illumination device includes a housing, with a display forming at least one surface of the housing. The display bears at least one inscription formed of a non-radioactive luminescent coating. An activation device for the phosphor-containing luminescent coating includes a battery or storage capacitor powered light which is programmed to emit a flash of light on appropriate intervals for periodic reactivation of the phosphors. The light is preferably in the UV frequency range. The display is, thus, enabled to emit light over a prolonged period of time.

Further objects and advantages of the invention will be apparent from the following detailed description, claims and the accompanying drawings.

DETAILED DESCRIPTION OF PREFERRED EMBODIMENTS

Figure 1:
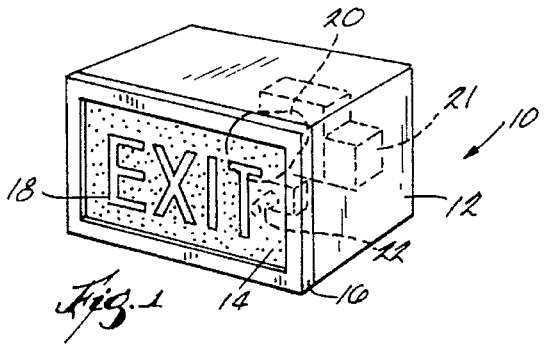
FIG. 1 is a perspective view of a sign incorporating an illumination system in accordance with the invention.
Figure 2:
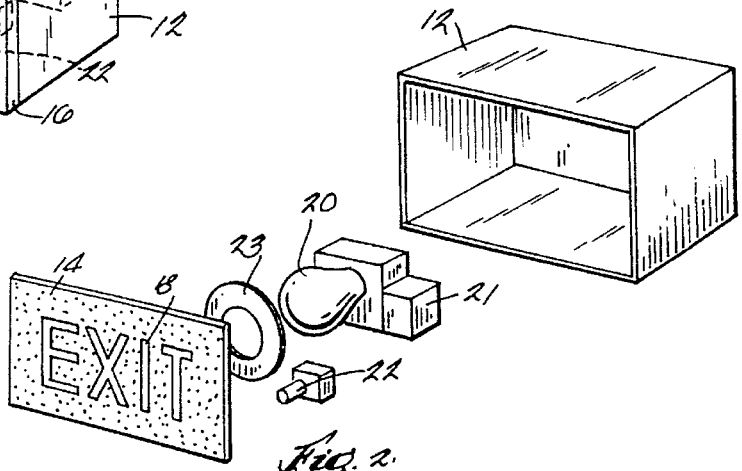
FIG. 2 is a perspective view of the device in FIG. 1 with parts spread apart for clarity.

Referring more specifically to the drawings, there is seen in FIG. 1 a self-illuminating sign device 10 suitable for placement in a location where electrical power is not readily available. Sign 10 includes a housing or enclosure 12 for containing the working mechanism of the device. A sign display 14 is held in place over one surface of housing 12 by means of a suitable bracket 16. Sign face 14 is generally opaque or translucent except in the areas 18 of an appropriate inscription which consists of a luminescent paint applied over a transparent area of the plate. Plate 14 can conveniently be made out of glass or a transparent plastic such as Lucite® polyacrylic polymer.

Contained also within housing 12 is a strobe light assembly 20 which is powered by means of an appropriate battery pack or storage capacitor 21. In accordance with a preferred embodiment, a UV filter 23 is provided to filter some selected frequencies of the light rays provided by strobe light assembly 20. In a preferred embodiment of the invention, filter 23 is of a type which allows passage therethrough of UV frequency light rays, which have been found effectively to activate the non-radioactive phosphors used in the practice of the invention. Thus, the phosphors can be periodically reactivated without the use of a strobe which emits a highly visible flash. A light monitoring means 22 of any commercially available type can be used to determine when the light intensity falls below a preselected light intensity threshold. Means 22 may then activate the strobe light assembly 20 to provide a flash of light.

Figure 3:
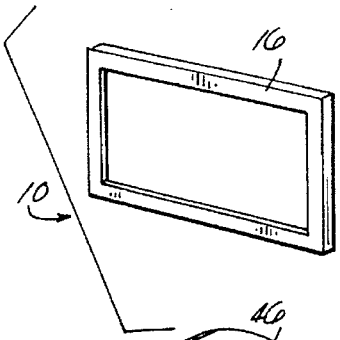
FIG. 3 is a perspective view of a clock showing another embodiment of the invention.
Figure 3:
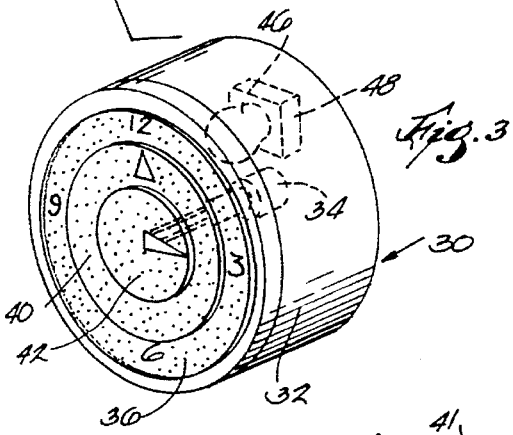
Figure 4:
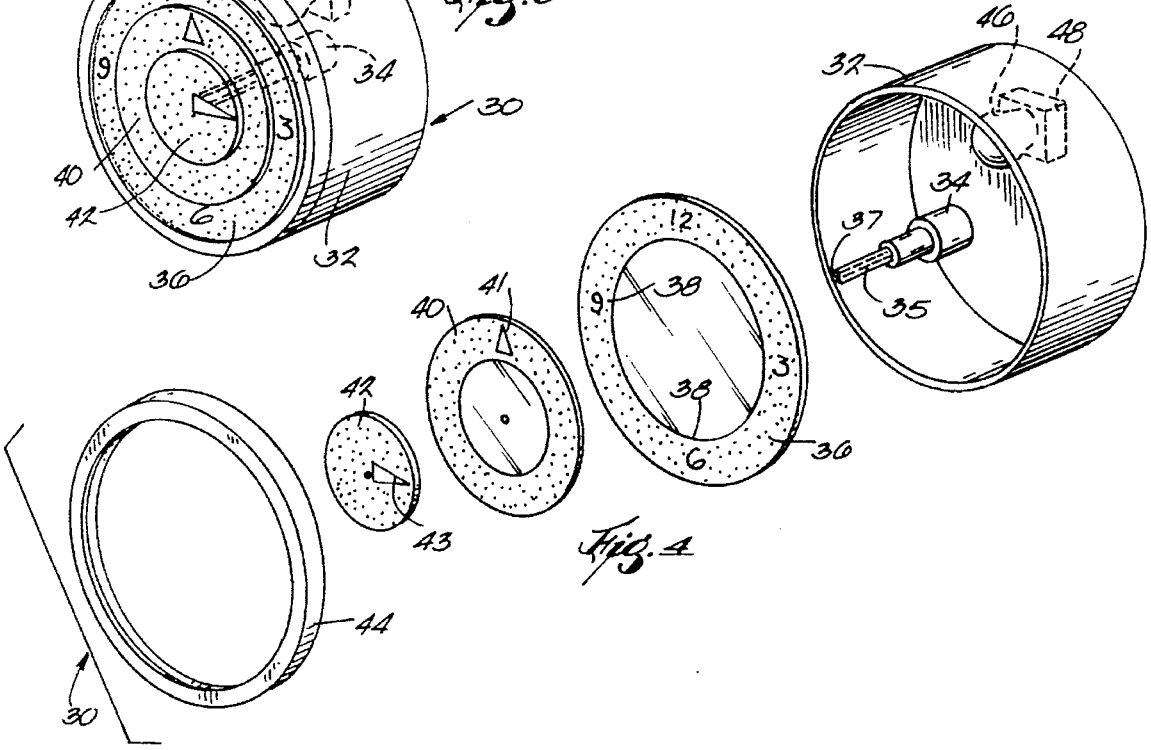
FIG. 4 is a perspective view of the clock in FIG. 3 showing the parts disassembled and spread apart for clarity.

Referring to FIG. 3 there is shown a clock 30 in accordance with the invention. Clock 30 includes a housing 32 within which a clock drive mechanism 34 is located. Mechanism 34 is provided with rotatable shafts 35 and 37 for driving the minute hand 41 on disc 40 and the hour hand 43 on disc 42. In the illustrated embodiment, the hour designation numerals 38 are marked on open-centered disc 36. Contained also within housing 32 is a strobe light assembly 46 which is powered by means of an appropriate battery pack or storage capacitor 48.

Disc faces 36, 40 and 42 are preferably generally opaque or translucent except in the areas 38, 41 and 43 which are coated with a non-radioactive non-luminescent paint in the shape of the appropriate inscriptions, preferably applied over transparent areas of the plates. The clock drive mechanism 34 can be arranged to control the times during which strobe light 48 is activated. The system can also be made programmable so that adjustments can be made for seasonally changing periods of longer or shorter daylight and darkness.

While specific embodiments of the invention have been shown for purposes of illustration, it will be understood that the scope of the invention is limited only by the following claims.

What is claimed is:

1. A low power consumption illumination device comprising a housing, a display forming at least one surface of said housing, said display bearing at least one inscription formed of a non-radioactive phosphor-containing coating, and an activation device for said phosphor-containing coating, said activation device including one of a battery and storage capacitor powered source of a beam of light, a means for causing said activation device to emit a flash of light on selected intervals for periodic reactivation of said phosphors, whereby said display emits light over a prolonged period of time, and wherein said light is controlled by a programmable control mechanism whereby said light can be programmed to periodically emit light only during periods of darkness.

2. A device according to claim 1 wherein said display comprises a clock face.

3. A device according to claim 1 wherein said source of a beam comprises a strobe light.

4. A device according to claim 1 further comprising a light monitoring means which activates said flash of light when said monitoring means detects a low light intensity emanating from said display which is below a preselected threshold light intensity.

5. A device according to claim 1 wherein said flash of light is filtered by means of a filter which permits passage therethrough of UV light while reducing passage therethrough of light of visible frequencies.

* * * * *